US008556598B2

(12) United States Patent
Zamudio et al.

(10) Patent No.: US 8,556,598 B2
(45) Date of Patent: Oct. 15, 2013

(54) SEALED COMPRESSOR WITH MULTIPLE COMPRESSOR UNIT

(75) Inventors: Carlos Zamudio, Lyons (FR); Joe T. Hill, Arkadelphia, AR (US)

(73) Assignee: Danfoss Scroll Technologies LLC, Arkadelphia, AR (US)

( * ) Notice: Subject to any disclaimer, the term of this patent is extended or adjusted under 35 U.S.C. 154(b) by 382 days.

(21) Appl. No.: 12/917,660

(22) Filed: Nov. 2, 2010

(65) Prior Publication Data

US 2012/0107158 A1 May 3, 2012

(51) Int. Cl.
*F04B 17/00* (2006.01)

(52) U.S. Cl.
USPC ..... 417/410.1; 417/426; 417/521; 418/55.1

(58) Field of Classification Search
USPC ..... 417/410.5, 521, 410.1, 423.5, 572, 902, 417/246, 247, 426, 423.14; 418/55.1–55.6
See application file for complete search history.

(56) References Cited

U.S. PATENT DOCUMENTS

| | | | | |
|---|---|---|---|---|
| 3,922,114 | A * | 11/1975 | Hamilton et al. | 417/366 |
| 5,211,031 | A | 5/1993 | Murayama et al. | |
| 5,385,453 | A * | 1/1995 | Fogt et al. | 417/410.5 |
| 6,478,550 | B2 * | 11/2002 | Matsuba et al. | 417/310 |
| 6,619,062 | B1 * | 9/2003 | Shibamoto et al. | 62/228.3 |
| 6,672,846 | B2 | 1/2004 | Rajendran et al. | |
| 6,790,017 | B2 * | 9/2004 | Takura et al. | 417/423.5 |
| 7,021,902 | B2 | 4/2006 | Terauchi | |

* cited by examiner

*Primary Examiner* — Charles Freay
*Assistant Examiner* — Joseph Herrmann
(74) *Attorney, Agent, or Firm* — Carlson, Gaskey & Olds, PC

(57) ABSTRACT

A sealed compressor has an outer housing and a separator plate received within the outer housing. The separator plate defines a suction chamber and a discharge pressure chamber within the outer housing. A locating plate is positioned within the suction pressure chamber. The locating plate has a plurality of positioning locations for receiving separate compressor housings. The separator plate has a plurality of positioning openings for receiving the separate compressors. A plurality of compressors are each received within their own housing, and include compressor pump units. The plurality of compressors extend between the openings in the locating plate and through the openings in the separator plate. The separate compressors deliver compressed refrigerant into the discharge pressure chamber.

9 Claims, 2 Drawing Sheets

SEALED COMPRESSOR WITH MULTIPLE COMPRESSOR UNIT

BACKGROUND

This application relates to a sealed compressor, wherein a plurality of separate compressor units are mounted within a single outside housing shell.

Sealed compressors are known, and typically include a housing shell defining a sealed chamber for receiving a motor and a compressor pump unit. Oil typically circulates within the sealed chamber, and is delivered by known means to surfaces between relatively moving parts.

A compressor assembly must be manufactured to be able to provide sufficient capacity to meet its largest required load. On the other hand, at most times, this largest load will not be encountered. Thus, the concept of "capacity control" is known in the refrigerant compressor art. Capacity control is the use of a reduced amount of compression, when less cooling capacity is necessary.

One simple method for providing capacity control would be to provide a plurality of compressor units, and shut them down one by one as the required capacity decreases.

In the past, it has been proposed to mount more than one compressor assembly within a single housing. The use of a single housing reduces the complexity of providing oil to each of the compressors. However, the proposed housing assemblies have had undesirable shortcomings.

SUMMARY

A sealed compressor has an outer housing and a separator plate received within the outer housing. The separator plate defines a suction chamber and a discharge pressure chamber within the outer housing. A locating plate is positioned within the suction pressure chamber. The locating plate has a plurality of positioning locations for receiving separate compressor housings. The separator plate has a plurality of positioning openings for receiving the separate compressors. A plurality of compressors are each received within their own housing, and include compressor pump units. The plurality of compressors extend between the openings in the locating plate and through the openings in the separator plate. The separate compressors deliver compressed refrigerant into the discharge pressure chamber.

These and other features of the present invention can be best understood from the following specification and drawings, the following of which is a brief description.

DETAILED DESCRIPTION

Figure 1:
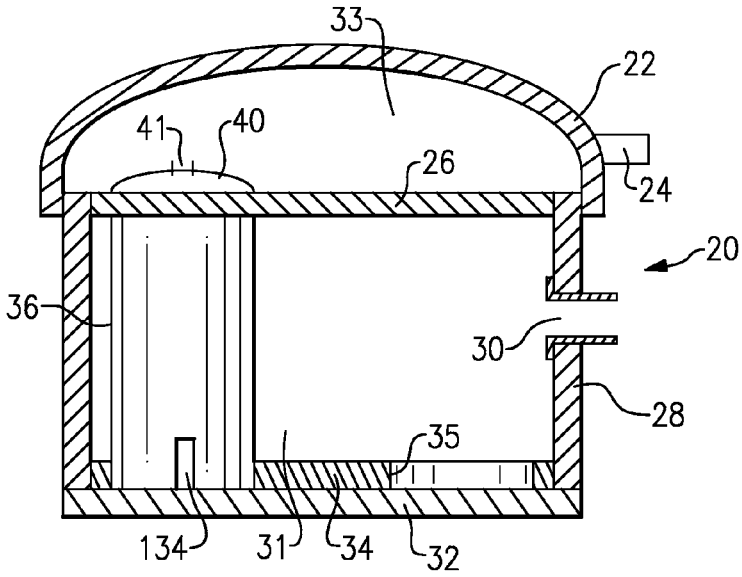
FIG. 1 shows a first embodiment.

A compressor unit 20 is illustrated in FIG. 1 having an outer housing 28 including a suction tube 30 for delivering a suction refrigerant into a chamber 31. A separator plate 26 is positioned at an upper end of the chamber 31 and defines a discharge pressure chamber 33 which is sealed from the suction pressure chamber 31. Chamber 33 communicates with a discharge pipe 24 in an upper housing shell 22.

A lower locating plate 34 is mounted to a base plate 32. The locating plate 34 has a plurality of locations 35 that mount separate compressor units 36. As shown, the compressor units 36 have an upper shell 40 extending through the separator plate 26. Refrigerant is compressed in the compressor units 36, from the suction chamber 31, and delivered through an opening 41 in the upper end of its shell into the chamber 33. Within outer housing 28, oil can move into the compressor units 36, such as by notches 134.

Figure 2:
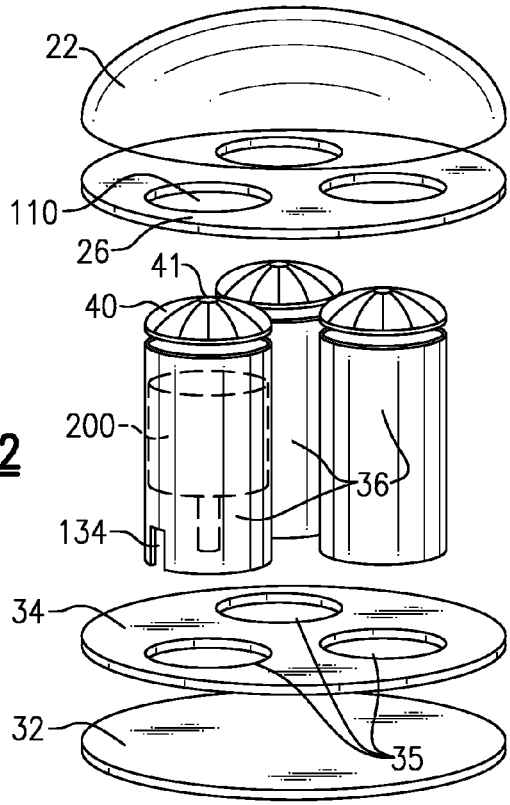
FIG. 2 shows the FIG. 1 embodiment partially exploded.

FIG. 2 shows the plate 34 having a plurality of alignment structures 35. Further, the separator plate 236 is shown to have a plurality of alignment openings 110. As shown schematically, a compressor pump unit 200 including a shaft is mounted within each of the separate compressor housings 36. The compressor pump units operate in a known manner to bring oil upwardly through the openings 134, such as by driving the associated shaft through an electric motor. In addition, the compressor pump units take in refrigerant from the suction pressure chamber 31, compress that refrigerant, deliver it through discharge opening 41, and into the discharge pressure chamber 33.

When assembled, each compressor unit 36 extends between the lower plate 34, and the upper plate 26. They are thus properly positioned and aligned within the overall outer housing.

Figure 3A:
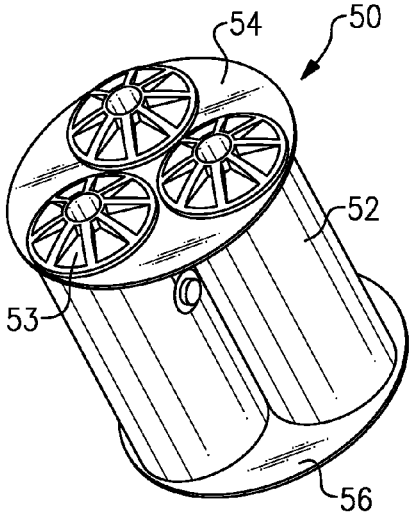
FIG. 3A shows a first view of a second embodiment.

FIG. 3A shows another embodiment 50, wherein the separate compressors 52 have upper ends 53 extending through the separator plate 54. The lower plate 56 is shown in FIG. 3A also securing the several compressors. The several compressors illustrated in this embodiment also include compressor pump units which function as described above.

Figure 3B:
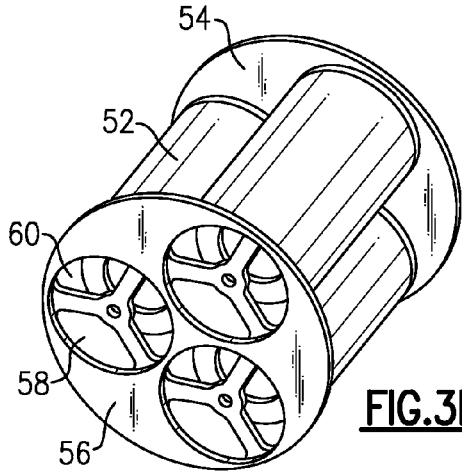
FIG. 3B shows another view.

As shown in FIG. 3B, the lower plate 56 has openings 58 that receive a lower end 60 of the shells 52. Further openings 58 allow the flow of oil into the bottom of the individual compressors.

Figure 3C:
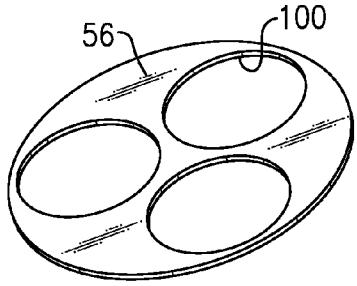
FIG. 3C is an exploded view of one portion of the second embodiment.
Figure 3D:
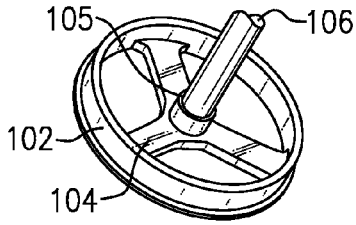
FIG. 3D shows another feature.

FIG. 3C shows the bottom plate 56 having holes 100 to receive the web members 102. As shown in FIG. 3D, the web members 102 have a web 104, and a central bearing 105 which receives a lower end of a shaft 106, shown schematically in this Figure. Notably, the FIG. 1 embodiment will also include a bearing mounting a driveshaft, as known.

Thus, the combination of the lower plate and the upper plate in this embodiment again serve to properly position the several compressor units.

As known, a central control can control the operation of the three compressors such that they can be shut off in a serial fashion to reduce capacity. In the preferred embodiments, at least one of the three compressors is a variable speed compressor, such that the variable speed allows the overall capacity to be varied from a lowest variable speed of one compressor, to the full speed of all compressors. Again, in a preferred embodiment, an electronic drive to run the variable speed need only be sized for one compressor and inside the shell. The common oil sump ensures that adequate oil will be provided to each of the compressors when they are running.

As an example, if there were three five-ton compressors, with one being a variable speed running from 1.5 to 6 ton, the three compressors inside the single housing could behave as a variable 16 ton compressor, but would only need a 6 ton electronic drive. A designer could operate the compressors to run between 1.5 to 16 ton by combining the variable speed, and control points to turn off and on the other two compressors.

Also, the compressors could have different capacities. As an example, one could have 2.5 ton, one 5 ton, and one 7.5 ton.

Then, a number of distinct operating points could be achieved, such as 2.5, 5, 7.5, 10, 12.5 and 15 ton. This arrangement would provide a wide variety of variable speed, with no requirement for a variable speed drive.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

an outer housing, a separator plate received within said outer housing, said separator plate defining a suction pressure chamber and a discharge pressure chamber within said outer housing;

a locating plate positioned within said suction pressure chamber, and said locating plate having a plurality of positioning locations each receiving a separate compressor housing, and said separator plate having a plurality of positioning openings receiving said separate compressor housings;

said separate compressor housings each enclosing compressor pump units, and extending between said locating plate and through said openings in said separator plate, said compressor pump units delivering compressed refrigerant into said discharge pressure chamber; and said locating plate being mounted to a base plate, said base plate being in contact with said outer housing to define said suction chamber, and said outer housing being in contact with an upper end shell to define said discharge pressure chamber, with each of said suction pressure chamber and said discharge pressure chamber also being defined by said separator plate, and a suction inlet for delivering refrigerant to be compressed into said suction pressure chamber, said suction inlet extending through said outer housing at a location intermediate said locating plate and said separator plate.

2. The sealed compressor as set forth in claim 1, wherein there are at least three of said separate compressor housings.

3. The sealed compressor as set forth in claim 2, wherein at least one of said at least three compressor pump units is provided with a variable speed drive.

4. The sealed compressor as set forth in claim 2, wherein the capacities of said at least three compressor pump units being distinct.

5. The sealed compressor as set forth in claim 1, wherein said separate compressor housings each have openings to allow the flow of oil from said outer housing into said separate compressor housings.

6. The sealed compressor as set forth in claim 1, wherein said locating plate is provided with a plurality of openings, each receiving a web support, said web support carrying a bearing for supporting a shaft for each of said compressor pump units.

7. The sealed compressor as set forth in claim 1, wherein at least one of said compressor pump units is provided with a variable speed drive.

8. The sealed compressor as set forth in claim 2, wherein the capacities of said compressor pump units being distinct.

9. The sealed compressor as set forth in claim 4, wherein said distinct capacities of the at least three compressor pump units include a first compressor pump unit having a 2.5 ton capacity;

a second compressor pump unit having a 5.0 ton capacity; and a third compressor pump unit having a 7.5 ton capacity.

* * * * *